United States Patent [19]

Byers et al.

[11] Patent Number: 4,721,551

[45] Date of Patent: Jan. 26, 1988

[54] IRIDIUM TREATMENT OF NEURO-STIMULATING ELECTRODES

[75] Inventors: Charles L. Byers, Canyon Country; Peter Zimmerman, San Francisco; Paul Feinstein, Berkeley; Mitchell Sutter, Emeryville, all of Calif.

[73] Assignee: The Regents of the University of California, Berkeley, Calif.

[21] Appl. No.: 927,809

[22] Filed: Nov. 6, 1986

[51] Int. Cl.[4] ..... C25D 3/50

[52] U.S. Cl. ..... 204/47; 128/303.13; 128/635; 204/280; 204/290 R; 204/291; 204/292

[58] Field of Search ..... 204/47, 280, 290 R, 204/291, 292; 128/303.13, 635

[56] References Cited

U.S. PATENT DOCUMENTS

| | | | |
|---|---|---|---|
| 3,207,680 | 9/1965 | Macnamara | 204/47 |
| 3,446,607 | 5/1969 | Volk et al. | 204/47 |
| 3,639,219 | 2/1972 | Skomoroski | 204/47 |
| 4,174,378 | 11/1979 | Scarpellino | 204/47 |
| 4,499,901 | 2/1985 | Chang et al. | 128/635 |
| 4,586,998 | 5/1986 | Wood | 204/47 |
| 4,587,001 | 5/1986 | Cairns et al. | 204/290 R |
| 4,592,824 | 6/1986 | Smith et al. | 125/635 |
| 4,672,970 | 6/1987 | Uchida et al. | 128/635 |

OTHER PUBLICATIONS

Conn; Plating Dec. 1965 p. 1258–1261.

*Primary Examiner*—Arthur P. Demers
*Attorney, Agent, or Firm*—Phillips, Moore Lempio & Finley

[57] ABSTRACT

Microelectrodes of the art are limited to the charge density which can pass through them. The present invention discloses a method for electroplating iridium metal onto the surface of a metallic microelectrode for use in a biomedical prosthetic device, which method comprises:

(a) placing the metallic microelectrode into an aqueous solution of iridium ion of between about 1 and 10 percent by weight; and (b) electroplating the microelectrode of step (a) using a current of between about 0.5 and 15 milliamps wherein said current is controlled by a current controller. In another aspect the method discloses in step (b) the current is also biased and simultaneously applied in a mode wherein the current is equivalent to an impressed voltage of between about 1.5 and 6.0 volts positive.

In other aspects, the method also includes the following :A-after step (b): (c) conditioning the microelectrode after step (b) by heating at a temperature of between about ambient and 350° C.; B-after step (c): (c-1) optionally subjecting the iridium-coated microelectrode of step to ultrasonic energy in the range of between about 1 and 20,000 hertz for between about 0.1 and 10 minutes in a phosphate buffered saline solution; after step (c-1): (d) conditioning the microelectrode of step (c-1) by storage for between about 6 and 150 hrs. in a physiologically equivalent phosphate buffered saline solution selected under in vitro conditions; D-after step (c-1): (d-1) conditioning the microelectrode of step (b-1) by placing it in vivo and conducting the conditioning in the presence of minor amounts liquid selected from natural body fluids or added synthetic liquids; and E-after step (b): (e) conditioning the microelectrode between about positive 1 and negative 1 volts for between 100 and 10,000 millivolts per second, for between about 1 and 100 cycles to form at least one iridium oxide on the surface of the microelectrode. The invention also discloses the use of these microelectrodes in devices and in microelectrodes and in these devices used in the method of treatment of neurological diseases.

23 Claims, 26 Drawing Figures

Plating Circuit

CVM DATA Aquisition System

FIGURE 3A

Charge Capacity vs Pulse Plating Frequency

| Frequency (hz) | 0.006 | 0.065 | 0.22 | 2.0 | 16 | 170 | 1400 |
|---|---|---|---|---|---|---|---|
| Pre-soak ucoul/cm2 | 8997 | 8520 | 8668 | 8504 | 9523 | 9191 | 9533 |
| Post-soak ucoul/cm2 | 7740 | 15900 | 10300 | 8926 | 14160 | 11890 | 14160 |

FIGURE 3B

Charge Capacity vs Temperature Dependence

| Oven Set | 4 hours @175°C. | 3.5 hours @250°C. | 3 hours @325°C. |
|---|---|---|---|
| Pre-soak ucoul/cm2 | 12460 | 7640 | 6860 |
| Post-soak ucoul/cm2 | 16240 | 10880 | 10470 |

FIGURE 3C

Charge Capacity vs Frequency Dependence

| Frequency (hz) | 0.065, 0.22, 2.0 | 16, 170, 1400 |
|---|---|---|
| Pre-soak ucoul/cm2 | 8600 | 8400 |
| Post-soak ucoul/cm2 | 11700 | 13400 |

Charge Capacity (in thousands of microcoulombs/cm2) for DC "Plated" Stimulating Electrodes

| | | time in plating sol. (min.) | | |
|---|---|---|---|---|
| | | 05 | 25 | 45 |
| Applied Voltage | 3V | 1.4 | 5.8 | 7.7 |
| | 4V | | 7.5 | 6.0 |
| | 5V | | 6.1 | 14.4 |

MS33 B325.0

| | | | |
|---|---|---|---|
| t=00 | 6620±376 | 48 HOUR SOAK | |
| t=15 | 8290±409 | t=00 | 10660±457 |
| t=35 | 8410±412 | t=15 | 12320±490 |
| t=65 | 8739±418 | | 11510±435 |
| t=80 | 8850±238 | | |
| t=95 | 8770±419 | | |
| | 8775±345 | | |

FIGURE 8
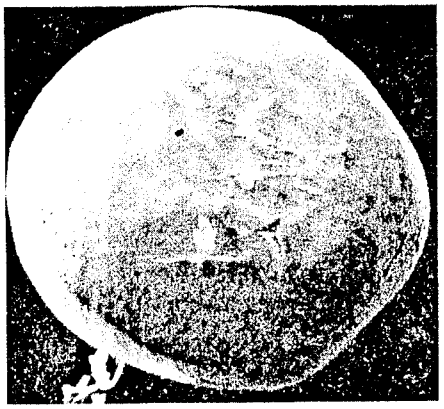
FIGURE 8B
Sonicated 300X
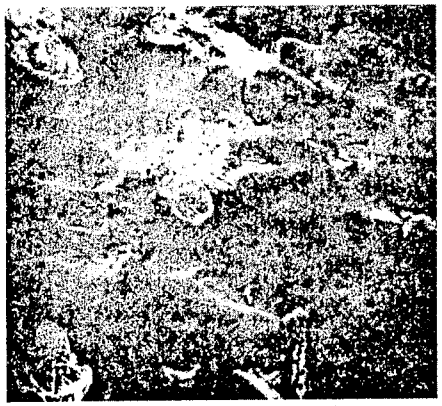
FIGURE 8D
Sonicated 1000X
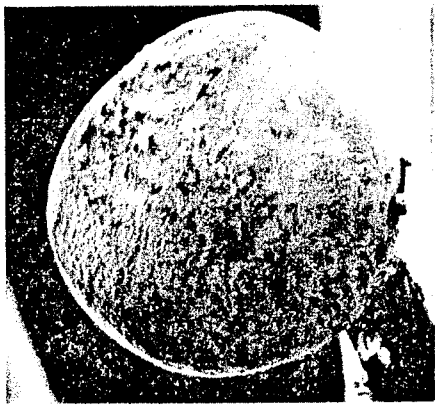
FIGURE 8A
MS33 B175 300X
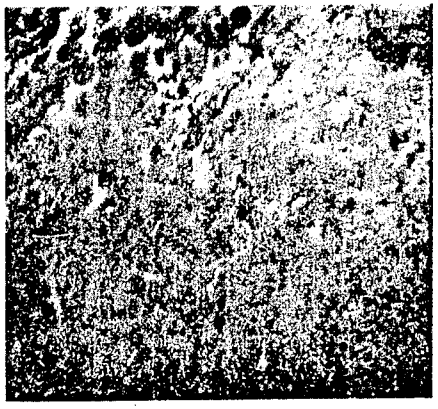
FIGURE 8C
MS33 B175 1000X FIGURE 10
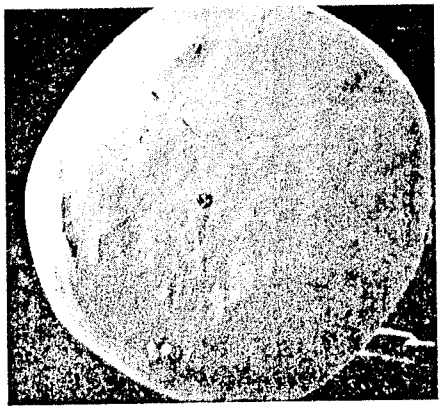
FIGURE 10B
Sonicated 300X
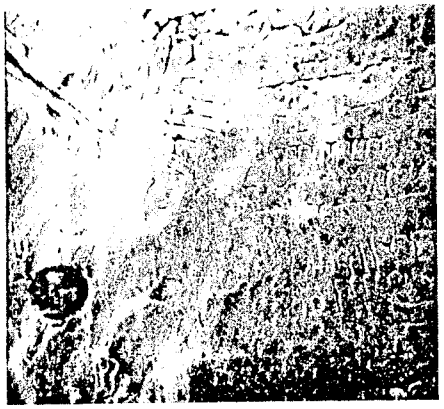
FIGURE 10D
Sonicated 1000X
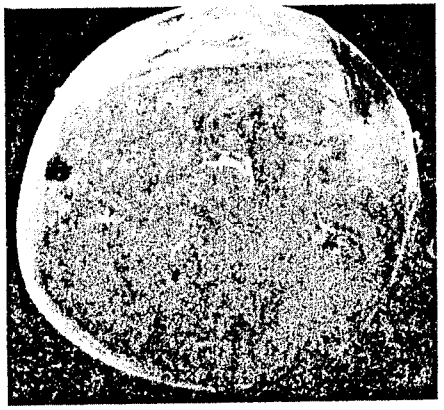
FIGURE 10A
MS33 B325 300X
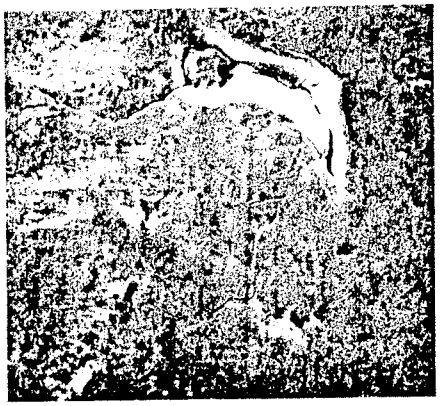
FIGURE 10C
MS33 B325 1000X

IRIDIUM TREATMENT OF NEURO-STIMULATING ELECTRODES

ORIGIN OF THE INVENTION

The research on the present invention was performed under one or more contracts granted by the National Institute of Health to the University of California, e.g. No. NO1-NS-3-2353. The U.S. Government has rights in the present invention.

BACKGROUND OF THE INVENTION

1. Field of the Invention

The present invention relates to the electrodeposition of iridium/iridium oxide onto the surface of a microelectrode. More particularly, the invention relates to an improvement in the electroplating of iridium onto the surface of a microelectrode comprising a transition metal or mixtures thereof. The electroplated microelectrode is capable of holding and transmitting a higher charge density in biomedical applications than presently available plated microelectrodes. These microelectrodes are particularly useful when used in conjunction with electrical devices to treat neurological diseases and conditions in living mammals.

2. General Description of the Field

The use of electrical stimulation of muscles and nerves in the body to overcome specific diseases and nerve conditions has been under experimentation for a number of years. The diseases and conditions include—hearing loss (cochlear implant), incontinence, or impotence (series of implanted electrodes), heart arrhythemia (pacemaker) retinal stimulation, spasticity, limb paralysis, and the like.

Although much of the early development was empirical, it was recognized that the implanted electrodes need specific desirable characteristics. First, the basic electrode material needed to be non-toxic. That is, with or without the electrical activity, the implanted metal did not cause tissue or nerve damage or necrosis in the short or long term. Second, the precise form of the electrical stimulations needed to insure that any electrical charge injected into living tissue be balanced to prevent any irreversible reactions which would dissolve or impair the electrode. It was found that copper, stainless steel, silver or other generally common electrode materials rapidly corrode when electrically charged in an electrolyte environment, such as body fluids. In the early research, certain metals were identified as generally being an acceptably low corrosion rate so long as the charge density was limited to 200 microcoulombs/cm$^2$ or less. Generally, these electrode materials include, for example, platinum, gold, iridium, rhodium, palladium, mixtures (or alloys) of these and the like.

For the stimulation of large-scale muscles and nerves, electrodes of the above metals or alloys were reasonably large in size; therefore, it was possible to keep stimulation parameters well within the charge density requirements. However, with the development of neural prosthetic devices for delicate structures such as the inner ear, eye, etc., microelectrodes smaller than those of the art were required. These microelectrodes and the electrical current density which was required to be transmitted through them quickly pushed to the limit the safe charge carrying capacity of the above-described metals and alloys in their present configurations.

In such delicate applications where the charge capacity required for electrical stimulation might be as high as 200 microcoulombs per square centimeter, the present microelectrodes are being driven dangerously close to the limit where irreversible dissolution and gas evolution occurs. The trend of the research was to go to much denser and smaller electrodes.

There are several known methods of increasing the capacity of a metallic electrode to carry and transfer an electrical charge. Since the charge is only safely transferred by the chemical reactions in which all products are insoluble and remain bonded to the electrode surface, the electrode charge capacity can be increased by identified electrode-bound reactions involving more electron transfers, i.e., valence states of the metallic oxides, Alternatively, discovering a method of increasing the real effective surface area of an electrode will allow more charge to safely flow through it.

The above described chemical design considerations are complicated and difficult, generally because material which may be optimal as an electrode for its mechanical properties may be far from optimal in terms of its electrical, chemical and biochemical properties. Specifically, a number of research groups have established that iridium and its oxides have more valence states than other metallic oxides, and it represents a greatly improved electrode interface as compared with platinum. However, iridium itself is generally not mechanically suitable as a material for a microelectrode. Some reports have been made about mechanically coating iridium onto the surface of platinum wires (which have good electrical and mechanical properties) by dipping in iridium chloride solution followed by heating (baking at 325° C. or higher) the iridium coating at elevated temperatures. This technique often resulted in greatly increased charge capacity of the microelectrode, but the iridium coatings were not predictable either electrically or mechanically. Iridium was electroplated onto the platinum electrode using conventional direct current (DC) electroplating techniques. These DC plated electrodes had increased in charge capacity, but the iridium coatings were not mechanically rugged. After being exposed to ultrasonication) (a conventional cleaning and testing technique), the charge capacities of the electrodes were very unpredictable. The fundamental problem underlying the lack of mechanical ruggedness is that the mechanical and chemical adhesion between the base platinum electrode and the iridium metal coating is generally not very good.

It is therefore desirable to have a technique which will produce a microelectrode having improved adhesion between the iridium coating and the base electrode and have predictable mechanical ruggedness to withstand the electrical, chemical and biological environments to which it will be subjected during use. It is also desirable to have methods available to condition iridium-coated microelectrodes to increase the overall charge density.

SUMMARY OF THE INVENTION

The present invention relates to a method for electroplating iridium metal onto the surface of a metallic microelectrode for use in a biomedical prosthetic device, which method comprises:

(a) placing the metallic microelectrode into an aqueous solution of iridium ion having between about 1 and 10 percent by weight iridium; and (b) electroplating the microelectrode of step (a) using a current either alternating current (AC) or direct current (DC) of between about 0.5 and 15 milliamperes wherein said current is controlled by a current controller.

In another aspect, in step (b) the current is also biased and simultaneously applied in a mode wherein the current is equivalent to an impressed cathodic voltage on the microelectrode of between about 1.5 and 6.0 volts.

In another aspect, the method includes after step (b):

(b-1) optionally rinsing the coated microelectrode of step (b) with an organic liquid selected from alcohols, ketones, aldehydes, esters, ethers or mixtures thereof having from 1 to 10 carbon atoms.

In yet another aspect, the method includes after step (b-1):

(c) conditioning the microelectrode after step (b-1) by storage or heating in air or oxygen at a temperature of between about 20° and 350° C. to produce at least one iridium oxide layer.

In still another aspect, the method includes after step (c) : (c-1) optionally subjecting the iridium-coated microelectrode of step (c) to ultrasonic energy in the range of between about 1 and 20,000 hertz for between about 1 and 10 minutes in a phosphorus buffered saline solution.

In another aspect the method also includes after step (c-1):

(d) conditioning the microelectrode of step (c-1) by subsequent storage for between about 6 and 150 hrs. in a physiologically equivalent phosphate buffered saline solution selected from in vitro conditions to activate the iridium oxide layer by hydration.

In another aspect, the method includes after step (c-1):

(d-1) conditioning the microelectrode of step (b-1) by placing it in vivo and conducting the conditioning in the presence of minor amounts of liquid selected from natural body fluids or added synthetic liquids.

In another aspect the method includes after step (b):

(e) conditioning the microelectrode by cycling between the positive and negative gassing voltages (i.e. generally between about positive 1 and negative 1 volts) at slew rates between about 100 and 10,000 millivolts per second, for between about 1 and 100 cycles to form at least one iridium oxide layer on the surface of the microelectrode.

In another aspect, the conditioning in step (e) occurring under applied voltage is conducted in vivo, controlled by programmable voltage means, and is powered by means effective to condition the microelectrode.

In another aspect, the metallic microelectrode in step (a) consists essentially of platinum, iridium or mixtures thereof, wherein the mixtures are between about 90/10 and 10/90 percent by weight.

In another aspect, in step (a) the constant controlled current is between about 1 and 11 milliamperes. The current in milliamperes is somewhat variable based upon the impedence which is a function of the area and composition of the electrode.

In another aspect, the microelectrode in step (a) consists essentially of platinum, iridium or mixtures thereof:

and in step (b) the pulsed current is applied at between 1 hertz about 20 kilohertz (cathodic voltage) with a duty cycle of between about 10 and 90%, preferably about 50%.

In another aspect, in step (a) the metallic microelectrode comprises platinum, iridium or mixtures thereof;

in step (b) the impressed current potential equal to between about 1.5 and 6 volts positive dependent upon the impedence of the gross microelectrode; and in step (c) the microelectrode is heated between about 50° and 325° C.

In another aspect, in step (a) the metallic microelectrode comprises platinum, iridium or mixtures thereof:

in step (b) the constant current is between about 1 and 11 milliamps and the voltage is between about 4.5 and 5.5 volts; and in step (d) the microelectrode is conditioned for between 100 and 150 hrs under in vivo conditions.

BRIEF DESCRIPTION OF THE DRAWINGS

FIG. 3A shows a table of charge capacity versus pulse plating frequency.

FIG. 3B shows a table comparing charge capacity versus temperature of baking.

FIG. 3C shows a table comparing charge capacity versus frequency.

FIG. 8 shows four scanning electron microscope (SEM) photographs at 300 power and 1000 power magnification of the microelectrodes previously conditioned at 175° C. before and after sonication:

FIG. 8A: 300×, before;

FIG. 8B: 300×, after;

FIG. 8C: 1000×, before;

FIG. 8D: 1000×, after.

FIG. 9 shows four SEM photographs at 300 power and 1000 power magnification of microelectrodes previously conditioned at 250° C. before and after sonication:

FIG. 9A: 300×, before;

FIG. 9B: 300×, after;

FIG. 9C: 1000×, before;

FIG. 9D 1000×, after.

FIG. 10 shows four SEM photographs at 300 power and 1000 power magnification of microelectrodes previously conditioned at 325° C. before and after sonication:

FIG. 10A 300×, before;

FIG. 10B 300×, after;

FIG. 10C 1000×, before;
FIG. 10D 1000×, after.

DETAILED DESCRIPTION OF THE INVENTION

DEFINITIONS

As used herein:

"Metallic" refers generally to a transition metal or alloy thereof. The metals of the noble metal triad of the Periodic Table are preferred. More preferred metals include platinum, palladium, titanium, iron (as stainless steel), iridium, gold, chromium, nickel, copper, molybdenum and alloys thereof. Especially preferred metals include alloys of platinum, iridium and rhodium particularly in the ratio of between about 10/90, and especially about 90/10 Pt/Ir.

"Prosthetic device" refers to a complete self-contained portable unit including, for example, power source, electronics, wires electrodes and the like. Preferred devices include, cochlear implants (hearing), retina implants (sight), muscle stimulators, bladder and erectile tissue stimulators, heart pacemakers and the like as described above. The preferred device is a cochlear implant especially using a Pt/Ir electrode.

"Metallic microelectrode" refers as an implantable metallic electrode useful for controlling and or stimulating nerve impulse by the transmission of controlled electrical charges. The electrodes are usually between about 1 square micron and 1 square millimeter in size, preferably between about 100 square microns and 0.01 square millimeters, and may be insulated in a conventional manner.

"Optionally", refers to a step, act or component which may or may not occur or be present in the invention.

In the present invention it was originally believed that the adhesion between the iridium coating and the gross metal electrode was primarily a factor of the parameters of the plating process. Specifically it was observed that conventional DC plating, by controlling the voltage across the electrode, was inadequate. The transfer of ions onto a surface occurs at optimal windows of voltage. The iridium oxides plated onto a platinum or platinum alloy are generally less conductive that the platinum itself. As plating progresses, the resistance increases and therefore the actual plating decreases or the current declines.

A solution to the above recited problem was to electroplate microelectrodes using a current controlled electrical pulse.

CONSTANT CURRENT AND PULSED PLATING

Figure 1:
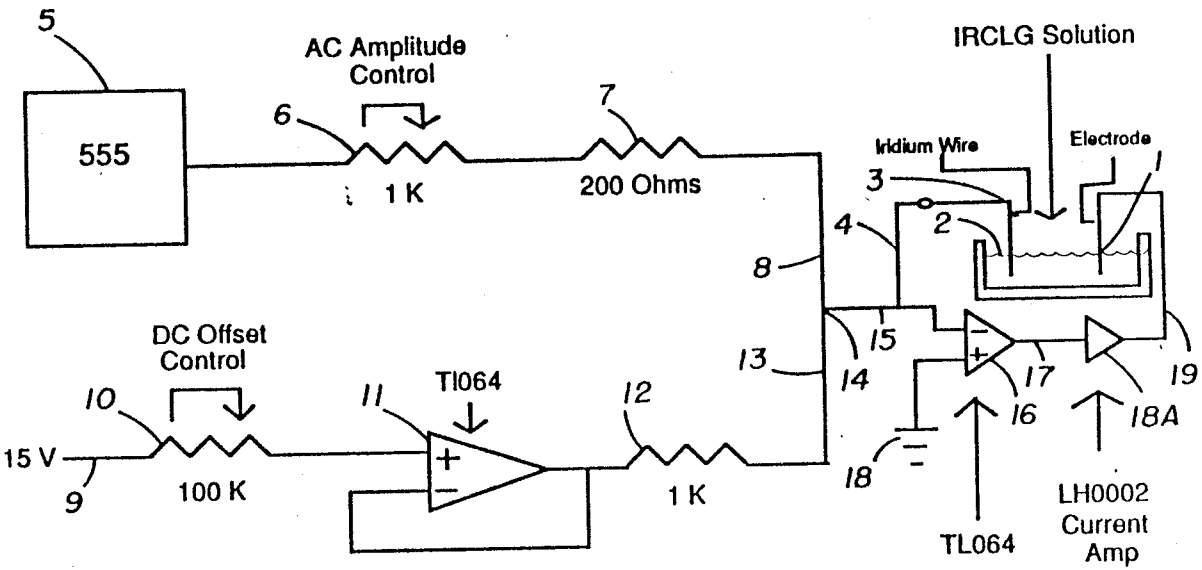
FIG. 1 shows a schematic diagram of the plating circuit.

The plating circuit shown in FIG. 1 was used. The platinum-iridium 90/10 (Pt-10Ir) electrode 1 was immersed in a 1 to 10% by weight iridium chloride solution 2 or similar iridium ion source. A preferred concentration is about 4%. An iridium wire 3 completes the connection to the remainder of the circuit.

The electrical charge from line 8 and line 13 are combined at point 14 and transmitted through line 15 to amplifier 16 which is grounded (at 18) transmitted 17 through current amplifier 18A: (such as, from National Semiconductor, Model LH0002), and connected (line 19) to the metallic electrode.

Alternating power source 5, such as a 555 timer chip configured as a 50% duty cycle square wave generation (such as National Semiconductor LINER databook for printout), is connected to alternating amplitude control 6 which is connected to 200 ohm resistor 7 and further to line 8. On the lower line 9, 15 volts are transmitted through DC offset control 10 and further to (such as Texas Instruments TL064 OP AMP amplifier 11) and 1000 ohm resistor 12 which is connected to line 13.

The current is controlled within 0.5 and 11 milliamps. The voltage is controlled between 2 and 5 volts. The pulsed plating is normally performed at a duty cycle of 50% for about 45 minutes. Times of between about 30 minutes to 100 minutes can also be used. The plated microelectrode is then rinsed, sonicated, thermally conditioned and/or conditioned in aqueous liquid in vitro or vivo. The variables of iridium concentration, current, voltage, time and duty cycle can be varied to obtain a useful microelectrode.

Figure 2:
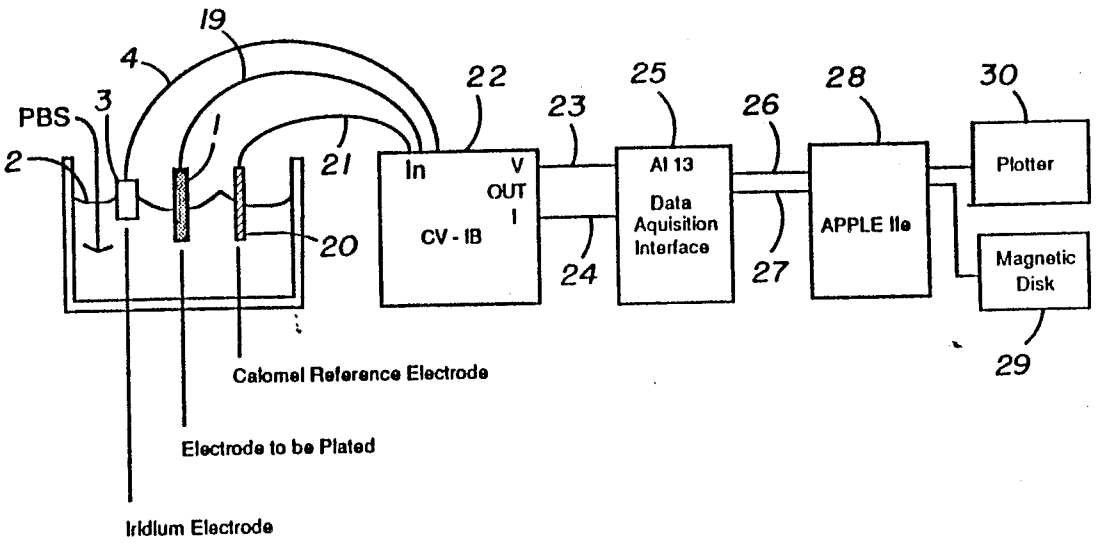
FIG. 2 shows a schematic of the CVM DATA Acquisition System.

In FIG. 2 is shown the data acquisition system for monitoring the controlled current and pulsed current aspects of the invention. The iridium source solution 2, iridium wire 3, connecting wire 4, electrode 1 and line 19 are as described for FIG. 1. Calomel reference electrode 20 is connected via line 21 as are lines 4 and 19 to cycled voltammograph or other suitable electrochemical means for assessing charge capacity, such as a voltmeter 22 (e.g., CV-1B cyclic voltmeter from Bioanalytical Systems. Inc. (BAS), West Lafayette, Ind. This unit is connected via lines 23 and 24 to data acquisition interface unit 25, such as a Data Acquisition System A1 13 available from Interactive Structures, Inc. of Bala Cynwyd, Pa.

Unit 25 is connected via lines 26 and 27 computer 28 for the recording and storing of data on magnetic disk 29. Personal computers, such as the APPLE II E, are preferred having an electronic plotter 30.

In the plating of iridium onto platinum/10% iridium mushroom electrodes (available from source ? STORZ' Instruments, Inc., St. Louis, Miss.) a controlled current pulse of electricity was obtained. Various frequencies (in hertz) were chosen as is shown in FIG. 3A. These charge capacity results are between about 100% higher (twice as high) than observed when conventional DC plating is conducted.

Figures 4A, 4B, 4C:
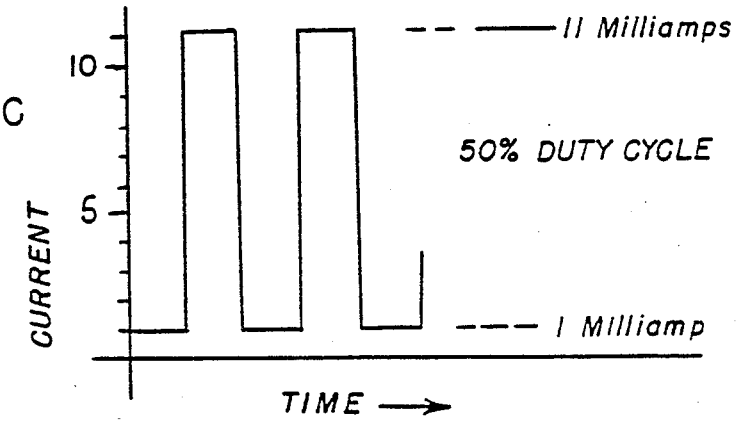
FIG. 4A shows charge capacity (in thousands of microcoulombs/cm$^2$ for direct current (DC) plated "stimulating" microelectrodes.
FIG. 4B shows a table of charge capacity of iridium plated microelectrodes before conditioning in a physiologically equivalent phosphate-buffer-saline solution and after conditioning.
FIG. 4C shows a representation of the constant current-pulsed current as a function of time.

The primary benefit of the pulsing was seen as a yet unreported disruption in the electroplating cycle which allows any of the polarizing effects on the surface of the microelectrode to dissipate, for example, small gas bubbles. In our research the electrical pulse was biased to just above 0 to prevent any possible reverse plating of the platinum from the electrode back into the plating solution. A diagrammatic representation of the pulsed constant current is shown in FIG. 4C between 1 and 11 milliamps having a 50% duty cycle.

In FIG. 3C is shown the comparison of charge capacity versus frequency. As can be seen the frequency does not have significant effect on the charge capacity.

RINSING OF THE IRIDIUM PLATED ELECTRODE

After the IR plating of the electrode is complete, optionally the electrode is rinsed using an organic liquid generally at ambient temperature. The electrode is simply dipped into the liquid 2 or 3 times over a 60 second period. The rinsing appears to remove some of the loose particles which adhere to the surface of the coated layer. Preferably the electrode is rinsed in an organic liquid which is selected from alcohols, ketones, aldehydes, ethers, esters and the like. Mixtures of the liquids are also useful. These organic liquids usually have between 1 and 10 carbon atoms and boiling point of less than 200° C.

In a preferred embodiment the rinsing is performed preferably aliphatic alcohols are used, especially isopropanol.

THERMAL CONDITIONING

The electrodes were then heated at various temperatures to "condition" the iridium coating. When temperatures of 325° C. were used for electrodes dip-coated with iridium, the electrodes were somewhat unpredictable as far as their charge density and usefulness was concerned, but were still higher than the charge densities on the unplated electrodes.

As is shown in FIG. 3B electrodes heated at 175° C. for 4 hrs. or at 250° C. for 3.5 hrs showed better charge density than did those electrodes heated for 3 hrs at 325° C.

SONICATION

The electrodes described above heated at 175°, 250° and 325° C. were optionally rinsed and subsequently treated with sonic energy (using, for example, a Bransonic 12 Ultrasound Instrument for between about 0.1 to 5 minutes (preferably between about 1 to 3 minutes) in a phosphate buffered saline solution. Usually about 20,000 hertz is employed.

Figure 5:
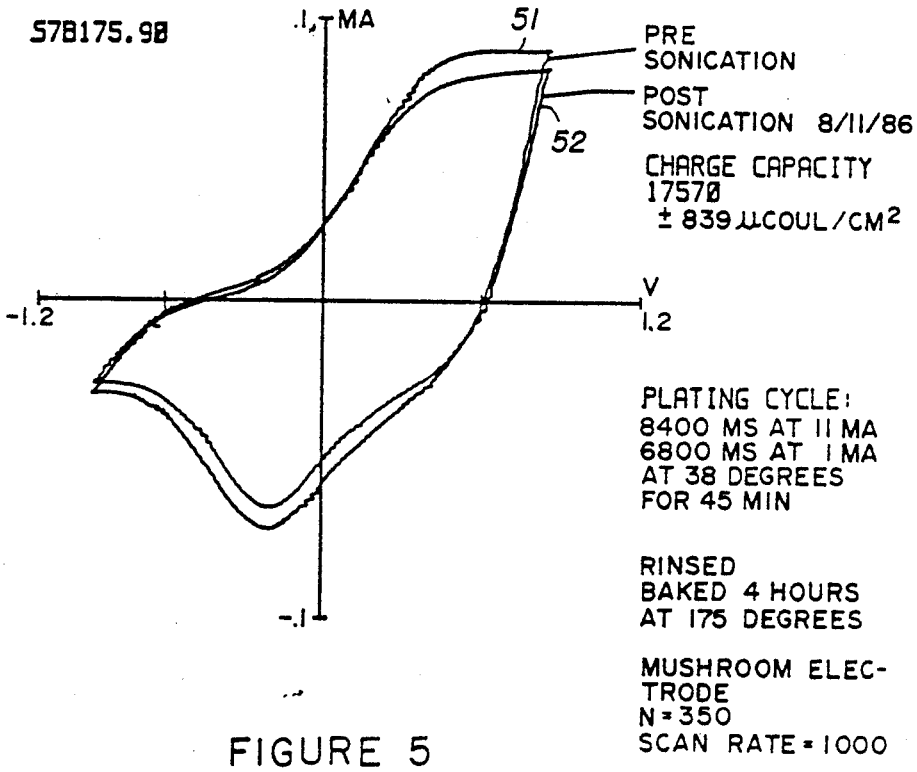
FIG. 5 shows a diagram of the charge capacity of an iridium plated microelectrode, wherein the microelectrode was previously conditioned at 175° C. for 4 hrs.
Figure 6:
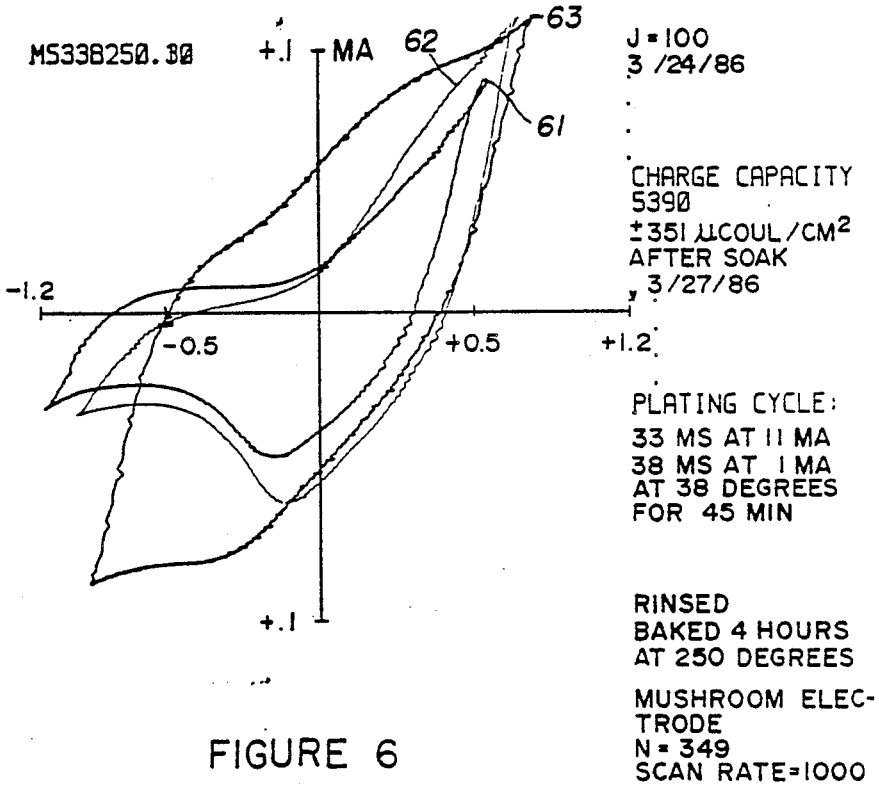
FIG. 6 shows a diagram of the charge capacity of an iridium plated microelectrode wherein microelectrode was previously conditioned at 250° C. for 4 hrs.
Figure 7:
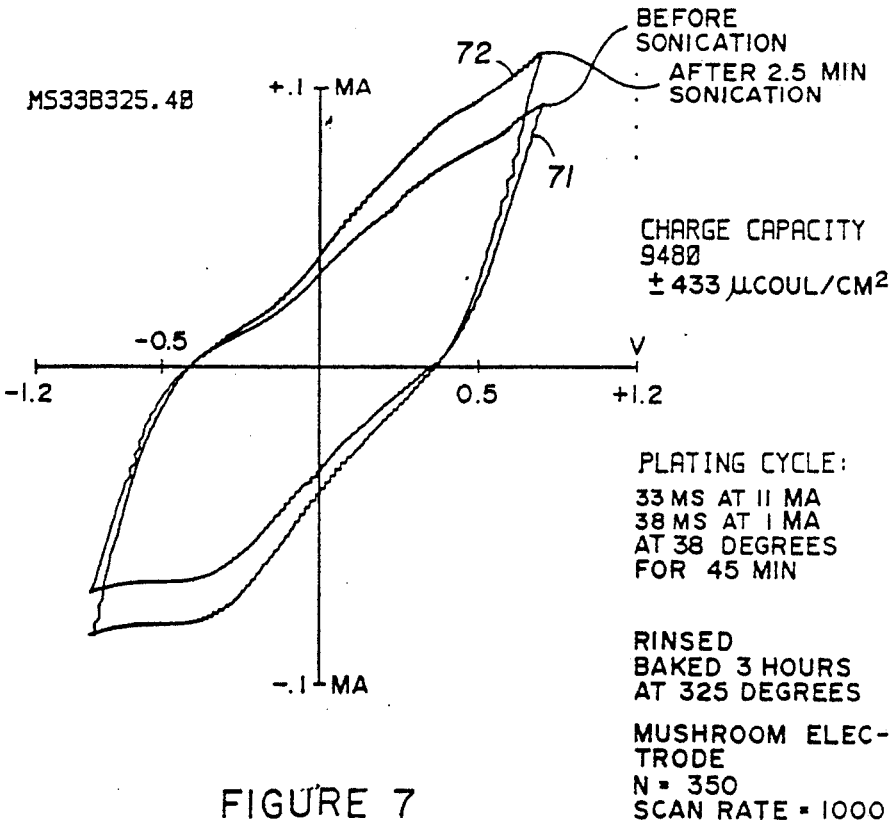
FIG. 7 shows a diagram of the charge capacity of an iridium plated microelectrode wherein the microelectrode was previously conditioned at 325° C. for 3 hrs.
Figures 9, 9A, 9B, 9C, 9D:
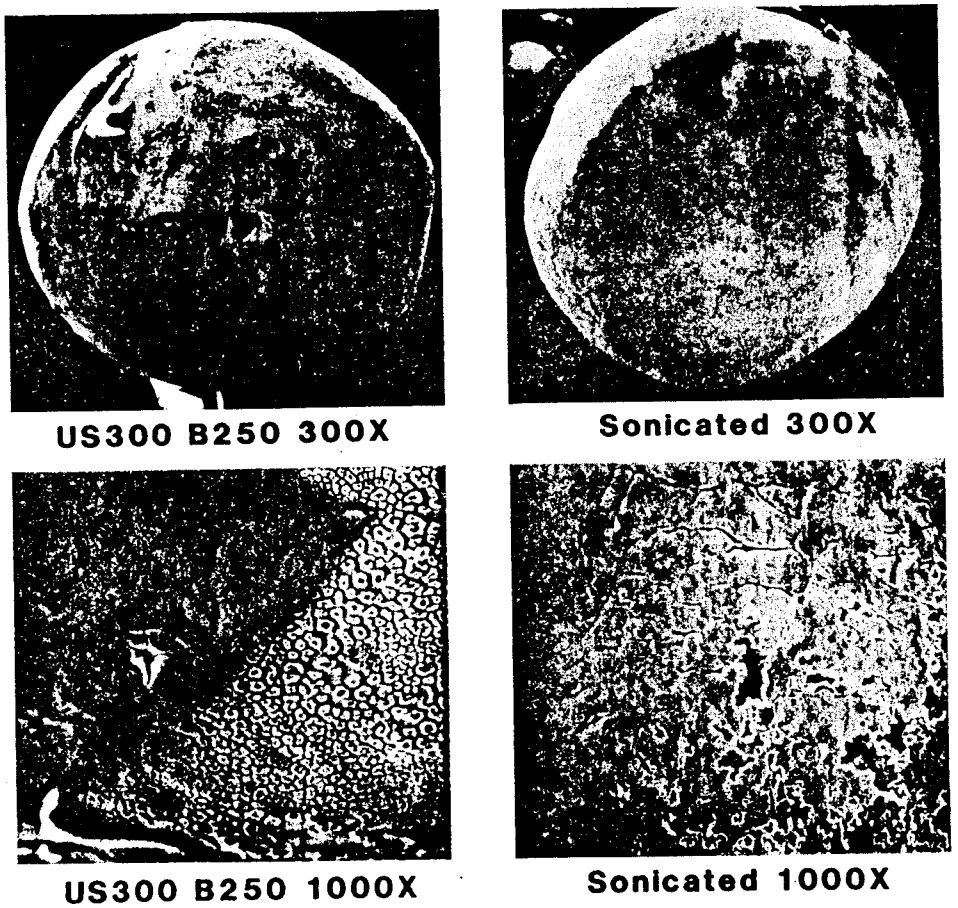

The results of the sonication are shown in FIGS. 8, 9 and 10. As can be seen by comparison of these photographs of the surfaces of the microelectrodes under 300 and 1000 magnification is that surface of the iridium-iridium oxide is smoother, cleaner and appears to have no loose debris. Large pits and the like have been removed. The charge capacity of the electrodes is shown in FIG. 3B. FIGS. 5, 6 and 7 also show the (current vs voltage) charge capacity of the electrodes heated at 175°, 250° and 325° C. The general physical shape of all microelectrodes remained essentially constant.

AQUEOUS CONDITIONING

After sonication, the electrodes were allowed to soak without voltage load in a simulated biological saline solution such as phosphate buffered (pH 7.3–7.4)-saline solution (0.1M sodium chloride) (in vitro conditions). The charge capacity improved dramatically and stabilized at the improved charge density value. These results can be seen in FIGS. 3A, 3B and 3C. It is also observed in FIGS. 5, 6 and 7. In many cases the charge capacity nearly doubled and remained high.

In FIGS. 5, 6 and 7, the vertical scale is in milliamperes +0.1 to −0.1, the horizontal scale is in volts: −1.2, −0.5, 0, 0.5 and +1. 2 the mushroom electrode has N=350; scan rate =1000.

In FIG. 5, is shown the microelectrode after rinsing is isopropanol before sonication and after sonication (52). The charge capacity is 1757±839 microcoulombs per square centimeter.

In FIG. 6 is shown the microelectrode after rinsing in isopropanol before sonication (61), after sonication (62) and after subsequent aqueous conditioning for about 48 hours (63). The charge capacity is 5,390±351 microcoulombs per square centimeter after the soaking in phosphate-saline as described herein.

In FIG. 7 is shown the microelectrode after rinsing in isopropanol before sonication (71) and after sonication (72) for 2.5 minutes. The charge capacity was 9.480±433 microcoulombs per square centimeter.

It is expected that the iridium plated microelectrode of the present invention can also be conditioned in vivo. That is, the microelectrode can be implanted, for instance, in the cochlea, and placed under minimal impedence while contacting the natural, primarily aqueous fluids of the human being, condition the microelectrode in place. When the microelectrode is then activated in place, it will be expected to have improved charge capacities of about 100% (i.e., 2×) more than those electrodes which are not conditioned using a physiological aqueous solution.

The present invention includes those methods of production as described and disclosed hereinabove. It also includes the metallic microelectrodes individually claimed in claims 16–23 appended hereinbelow. The invention also includes a medical device useful to administer controlled electrical charges to stimulate specific living mammilian tissue in the treatment of nerve cells of a neurological disease in a mammal, e.g., incorporating and using a metallic microelectrode of claims 16–23. The present invention also includes a method for treating a neurological disease in a mammal, preferably a human being, which comprises administering a therapeutically effective electrical charge to living mammillian tissue using an electrical medical device incorporating a metallic coated microelectrode of claim 16–23.

Finally, the present invention includes an iridium-/iridium oxide plated microelectrode (preferably of platinum—10% iridium) of the type produced herein is of the order of 20,000 to 25,000 microcoulombs per square centimeter or possible even higher (as a stable charge density). Preferably the charge density is about 22,000 microcoulombs per square centimeter.

While some embodiments of the present invention have been shown and described herein, it will be apparent to those skilled in the art that various modifications and changes can be made in the disclosed methods to electroplate iridium onto metallic microelectrodes and to condition these electrodes for use in electrical devices to treat neurological conditions in mammals without departing from the spirit and scope of the present invention. All such modifications and changes coming within the scope of the appended claims are intended to be covered thereby.

We claim:

1. A method for electroplating iridium metal onto the surface of a metallic microelectrode for use in a biomedical prosthetic device, which method comprises:
   (a) placing the metallic microelectrode into an aqueous solution of iridium ion of between about 1 and 10 percent by weight iridium; and
   (b) electroplating the microelectrode of step (a) using a current of between about 0.5 and 15 milliamperes wherein said current is controlled by a current controller.

2. The method of claim 1 wherein in step (b) the current is also biased and simultaneously applied in a mode wherein the current is equivalent to an impressed voltage of between about 1.5 and 6.0 volts positive.

3. The method of claim 2 wherein after step (b):
   (b-1) optionally rinsing the plated electrode with an organic liquid or mixture thereof having from 1 to 10 carbon atoms and a boiling point of between about 35° and 200° C.

4. The method of claim 3 wherein the method includes after step (b-1):

(c) conditioning the microelectrode after step (b) by heating at a temperature of between about ambient and 350° C.

5. The method of claim 4 wherein the method includes after step (c): (c-1) optionally subjecting the iridium-coated microelectrode of step to ultrasonic energy in the range of between about 1 and 10,000 hertz for between about 0.1 and 5 minutes in a phosphate buffered saline solution.

6. The method of claim 5 wherein the method includes after step (c-1):

(d) conditioning the microelectrode of step (c-1) by storage for between about 6 and 150 hrs in a physiologically equivalent phosphate buffered saline solution under in vitro conditions.

7. The method of claim 5 wherein the method includes after step (c-1):

(d-1) conditioning the microelectrode of step (c-1) by placing it in vivo and conducting the conditioning in the presence of minor amounts liquid selected from natural body fluids or added synthetic liquids.

8. The method of claim 2 wherein the method includes after step (b):

(e) conditioning the microelectrode by cycling between the positive and negative gassing voltages at slew rates between about 100 and 10,000 millivolts per second, for between about 1 and 100 cycles to form at least one iridium oxide layer on the surface of the microelectrode.

9. The method of claim 8 wherein the conditioning in step (e) occurring under applied voltage is conducted in vivo, controlled by programmable voltage means, powered by means effective to condition the microelectrode.

10. The method of claim 1 wherein the metallic microelectrode in step (a) consists essentially of platinum, iridium or mixtures thereof, wherein the mixtures are between about 90/10 and 10/90 percent by weight.

11. The method of claim 10 wherein in step (a) the constant controlled current is between about 1 and milliamps.

12. The method of claim 2 wherein the microelectrode in step (a) consists essentially of platinum, iridium or mixtures thereof:

and in step (b) the pulsed current is applied at between 1 hertz about 20 kilohertz with a duty cycle of between about 10 and 90%.

13. The method of claim 4 wherein:

in step (a) the metallic microelectrode comprises platinum, iridium or mixtures thereof;

in step (b) the impressed current is equal to between about 1.5 and 5 volts positive dependent upon the impedence of the base microelectrode; and in step (c) the microelectrode is heated between about 50 and 325° C.

14. The method of claim 13 wherein in step (c) the heating is between about 150° and 200° C.

15. The method of claim 6 wherein:

in step (a) the metallic microelectrode comprises platinum, iridium or mixtures thereof:

In step (b) the constant current is between about 1 and 11 milliamps and the voltage is between about 4.5 and 5.5 volts; and in step (d) the microelectrode is conditioned for between 100 and 150 hrs under in vivo conditions.

16. The metallic microelectrode obtained by the method of claim 1.

17. The metallic microelectrode obtained by the method of claim 2.

18. The metallic microelectrode obtained by the method of claim 4.

19. The metallic microelectrode obtained by the method of claim 5.

20. The metallic microelectrode obtained by the method of claim 6.

21. The metallic microelectrode obtained by the method of claim 9.

22. The metallic microelectrode obtained by the method of claim 12.

23. The metallic microelectrode obtained by the method of claim 13.

* * * * *